US010800126B2

(12) United States Patent
Oberhauser et al.

(10) Patent No.: US 10,800,126 B2
(45) Date of Patent: Oct. 13, 2020

(54) MACHINE AND METHOD FOR PRODUCING BAGS

(71) Applicant: Holweg Group, Molsheim (FR)

(72) Inventors: Freddy Oberhauser, Strasbourg (FR); Dominique Morel, Obernai (FR); Cedric Ritondo, Eschau (FR)

(73) Assignee: HOLWEG GROUP, Molsheim (FR)

( * ) Notice: Subject to any disclaimer, the term of this patent is extended or adjusted under 35 U.S.C. 154(b) by 306 days.

(21) Appl. No.: 15/744,928

(22) PCT Filed: Jun. 29, 2016

(86) PCT No.: PCT/FR2016/051619

§ 371 (c)(1),
(2) Date: Jan. 15, 2018

(87) PCT Pub. No.: WO2017/021597

PCT Pub. Date: Feb. 9, 2017

(65) Prior Publication Data

US 2018/0207897 A1 Jul. 26, 2018

(30) Foreign Application Priority Data

Jul. 31, 2015 (FR) ..... 15 57350

(51) Int. Cl.
*B31B 70/26* (2017.01)
*B31B 70/16* (2017.01)
(Continued)

(52) U.S. Cl.
CPC ..... *B31B 70/261* (2017.08); *B31B 50/16* (2017.08); *B31B 70/006* (2017.08); *B31B 70/16* (2017.08);
(Continued)

(58) Field of Classification Search
CPC ..... B31B 70/14; B31B 70/16; B31B 70/20; B31B 70/261; B31B 70/83; B31B 70/982; B31B 70/25; B31B 70/56; B31B 2155/003
(Continued)

(56) References Cited

U.S. PATENT DOCUMENTS 1,873,634 A * 8/1932 Potdevin ..... B31B 70/00 493/231
1,900,288 A * 3/1933 Jordhoy ..... B65H 45/161 270/50
(Continued)

FOREIGN PATENT DOCUMENTS

EP 0 560 066 9/1993
FR 786579 9/1935
(Continued)

OTHER PUBLICATIONS

International Search Report dated Sep. 29, 2016 (4 pages including English translation) from PCT Priority Application No. PCT/FR2016/051619.

*Primary Examiner* — Hemant Desai
*Assistant Examiner* — Veronica Martin
(74) *Attorney, Agent, or Firm* — Brinks Gilson & Lione; John C. Freeman

(57) ABSTRACT

A machine for producing bags includes a station for forming a tube, which forms a band of transversely perforated flexible material into a tube, a holding station for retaining the tube, a folding station for forming a bottom at the end of the tube, a folding roller having a folding blade for folding a flap at the end of the tube and a tear-off bar for pinching the tube against the drum, the folding station and the holding station being configured to jointly exert a traction on the tube and detach a portion of the tube. The tear-off bar is disposed
(Continued)

behind the folding blade, the machine controlling the rotation of the folding station to synchronize the drum with the front of the tube.

11 Claims, 3 Drawing Sheets

(51) Int. Cl.
*B31B 50/16* (2017.01)
*B31B 70/00* (2017.01)
*B31B 70/62* (2017.01)
*B31B 160/10* (2017.01)
*B31B 155/00* (2017.01)

(52) U.S. Cl.
CPC ..... *B31B 70/62* (2017.08); *B31B 70/004* (2017.08); *B31B 2155/00* (2017.08); *B31B 2155/003* (2017.08); *B31B 2160/10* (2017.08)

(58) Field of Classification Search
USPC ..... 493/119, 223, 236, 239, 340, 356, 230, 493/231, 234, 240, 241, 245, 257–260
See application file for complete search history.

(56) References Cited

U.S. PATENT DOCUMENTS 2,040,953 A * 5/1936 Poppe ..... B31B 70/00 493/231
2,124,209 A * 7/1938 Poppe ..... B31B 70/00 493/230
2,191,497 A * 2/1940 Potdevin ..... B31B 70/00 225/96
2,205,005 A * 6/1940 Anderson ..... B31B 70/00 493/197
2,476,057 A * 7/1949 Mead ..... B31B 70/00 493/236
3,114,299 A * 12/1963 Entzminger ..... B31B 70/00 493/239
3,203,323 A * 8/1965 Adams ..... B31B 70/00 493/234
3,537,359 A * 11/1970 Adele ..... B31B 70/00 493/11
3,837,266 A * 9/1974 Honsel ..... B65H 45/162 493/246
4,256,023 A * 3/1981 Vodarich ..... B31B 70/00 493/266
4,634,414 A * 1/1987 Hollmann ..... B31B 70/00 493/210
4,917,665 A * 4/1990 Couturier ..... B65H 45/24 493/359
5,000,729 A * 3/1991 Yamauchi ..... B65H 45/24 493/359
5,004,451 A * 4/1991 Prum ..... B65H 45/167 493/359
5,312,032 A * 5/1994 Rautenberg ..... B65C 9/183 156/DIG. 33
5,647,524 A * 7/1997 Rautenberg ..... B26F 3/002 225/100
5,806,392 A * 9/1998 Cleall ..... B26D 7/1818 83/155
5,921,906 A * 7/1999 Nagano ..... B65H 45/28 493/353
6,551,227 B1 * 4/2003 Whitten ..... B65H 35/08 493/356
6,569,074 B2 * 5/2003 Bluemle ..... B31B 70/00 271/184
6,913,567 B2 * 7/2005 Hartmann ..... B65H 29/56 493/194
2018/0319115 A1 * 11/2018 Fichtner ..... B31D 1/06

FOREIGN PATENT DOCUMENTS

FR 829591 6/1938
FR 2 716 182 8/1995

* cited by examiner

MACHINE AND METHOD FOR PRODUCING BAGS

This application claims priority to International Application No. PCT/FR2016/051619 filed Jun. 29, 2016 and to French Application No. 1557350 filed Jul. 31, 2015; the entire contents of each are incorporated herein by reference.

TECHNICAL FIELD

The present invention concerns a machine for producing bags, in particular bags made from a flexible material such as paper, aluminum, plastic or a combination of these materials. It equally concerns a production method employed by a machine of this kind.

PRIOR ART

To produce bags, in particular paper bags, industrially one known technique consists in forming a tubular body from a band of paper on a roll, separating lengths from this tubular body and closing one of the ends of the length to form a bag. The bag can also include a plastic material part, which is for example transparent, glued to the paper by overlapping respective edges.

Document FR 786 579 shows several examples of this technique. It shows in particular in FIGS. 4 to 6 a production method in which the band of paper includes at regular intervals lines of transverse perforations with a line at the center and two lines offset axially relative to the center line on each width of the band.

The tubular body is formed by folding each edge over the central part and gluing the two edges together along a central join so the perforations form two offset transverse lines on respective faces of the tubular body. The tubular body formed in this way passes between a pair of drive rollers that drive the tubular body at a constant speed. The front part of the tubular body is grasped by the folding device that includes a drum and a contra rotating folding roller. The drum and the folding roller rotate with a peripheral speed higher than that of the pair of drive rollers. The folding roller includes a bar adapted to clamp the front of the tubular body against the drum so the front part of the tubular body is pulled and separated by tearing it along the perforations to form a length. Upon separation, because of the offsets between the lines of perforations, a rear lug is formed on the length and likewise a front lug at the end of the tubular body. This front lug will be found on the next length. The front lug is folded by the folding device onto a glued area to close the front part of the length. To this end the roller further includes a folding blade placed just behind the bar that pushes the tubular body into a clamp carried by the drum to fold the tubular body.

To adjust the machine for a particular length of bag it is necessary to have the end of the tubular body coincide with the folding area of the folding station. To this end it is necessary to adjust the peripheral speed of the drum and of the folding roller relative to that of the tubular body. Thus the speed difference between the drum and the drive rollers cannot be controlled independently of the length of the bags. Moreover, the gap between the bar and the folding blade is very narrow and constrains the geometry and the position of the fold in the tab.

The same document proposes adding a pair of separation rollers between the pair of drive rollers and the folding device to be able to perform the separation function at the location of the folding device. The document FR 829 591 also proposes adding a pair of auxiliary rollers between the drive rollers and the separation rollers clamping the tubular body only during the separation operation. This solution is in widespread use. However, it does not allow the greatest accuracy because the detached portion must be taken up by transport means between the position in which separation occurs and the taking up of the length by the folding station. This loss of accuracy is particularly noticeable if the fold of the flap to be glued is also the limit of different printings. Moreover, it necessitates the provision of the transport means, which are generally in the form of looped belts on either side of the path of the bags. The belts can receive glue residue which soils them and creates risks of jamming if a bag remains stuck to a belt.

Moreover, the length of the bags produced is changed by changing the speed ratio between the drive rollers and those performing the separation to cause a larger or smaller portion of the tubular body to pass during each separation cycle. For example, to produce a shorter bag it is necessary to reduce the rotation speed of the drive rollers relative to that of the folding drum to shorten the interval between the perforations. However, the speed difference is limited by constraints on the tubular body during the separation phase, which limits the choice of possible bag lengths.

There are moreover known machines suitable for the production of short bags in which the distance between the holding station and the folding station is adjustable to adapt to the length of the bag. In this arrangement the machine does not include transport means between the holding station and the folding station. The adjustment of the machine is relatively time-consuming and the maximum length of the bags is limited.

DESCRIPTION OF THE INVENTION

The invention aims to provide a machine for producing bags allowing a greater choice of bag lengths with very easy adjustment, less risk of jamming and greater accuracy.

With these objectives in mind, the invention consists in a machine for producing bags, including a station for forming a tubular body for forming into a tubular body a band of flexible material transversely perforated at intervals, a holding station for retaining the tubular body, a folding station for forming a bottom at the end of the tubular body, the folding station including a drum and a folding roller mounted to rotate about axes parallel to one another, the folding roller including a folding blade for folding a flap at the end of the tubular body in co-operation with a clamp at the periphery of the drum to form the bottom, the folding station including tear-off means comprising a tear-off bar for clamping the tubular body against the drum, the folding station and the holding station being configured jointly to exert traction on the tubular body when the perforations are between the two stations and to detach a portion of the tubular body, the machine being characterized in that the tear-off bar is disposed to separate the tubular body portion when the bottom of said tubular body portion has already been formed, the machine including control means for controlling the rotation of the drum to synchronize it with the front of the tubular body.

Controlling the rotation speed of the drum allows it to be adapted to the various phases of a cycle, in particular from the folding phase to the separation phase, so the speed difference between the speed of the tubular body and that of the periphery of the drum is suitable regardless of the length of the bags. This speed adaptation allows imparting to the folding blade during folding a speed which is that of the tubular body. The tubular body is then pinched between the drum and the tear-off bar so the holding station can function when the perforations are located between the holding station and the folding station. During its operation the speed of the tear-off bar is higher than the peripheral speed of the rollers of the holding station. This allows great freedom of choice on the length of the bag with no constraint on its maximum length. As folding occurs when the length has not yet been separated from the tubular body, great accuracy is achieved on the position of the fold.

According to a first embodiment the drum and the folding roller are mechanically synchronized. If they have the same diameter they turn at the same rotation speed. In some versions the folding roller has half the diameter of the drum and turns twice as fast and the drum includes twice as many clamps as the folding roller includes folding blades. Other ratios can be envisaged.

According to a second embodiment the rotation of the drum and the rotation of the folding roller are controlled separately. The number of folding blades and clamps on the drum are therefore independent. Moreover, it is possible to adjust the machine to use all the clamps or only some of them entirely by programming the control means without modifying the mechanical configuration of the machine. This operation is very fast, which reduces machine down-time and allows high productivity.

According to one constructive feature, the tear-off bar is carried by the folding roller. The folding and tearing off functions are therefore performed by the same roller, which simplifies the construction of the machine.

According to another constructive feature, the tear-off means include a tear-off roller carrying the tear-off bar. Bringing the tear-off bar into contact with the drum can therefore be controlled independently of the folding roller, which reduces the constraints, in particular on folding roller speed variation. The tear-off roller can be positioned in the vicinity of the folding roller so it remains possible to produce short bags by performing the separation between the bag and the tubular body at a short distance from the folding location. It is equally possible to position the tear-off roller downstream of the folding roller, which enables the place of separation of the bag and the tubular body to be as close as possible to the folding roller.

In a complementary manner, the machine includes a perforation station for transversely perforating the band of flexible material.

According to an improvement, the control means control the perforation station to perforate the band at a chosen location. This feature adds further flexibility of use of the machine by making it possible to modify the length of the bags produced entirely by programming the control means without intervention on the mechanical means.

In a complementary manner the control means control the holding station. The time to hold the tubular body to produce the separation is therefore also controlled by programming the control means without intervention on the mechanical means. The rotation speed is adjusted during a revolution to synchronize the clamping of the tubular body with the clamping of the front of the tubular body onto the drum. The speed can also be continuous and simply adapted to the type of bag to be produced and to the speed of movement of the tubular body.

According to one constructive feature, the drum includes at least two clamps distributed over the periphery for grasping the front of the tubular body.

According to an improvement the folding blade is cyclically retractable. Retraction can be effected by a system of cams inside the folding roller or by movement away of the folding roller itself. This retraction for example enables avoidance of clamping of the tubular body one time in two or more, to produce a longer bag without having to stop the folding roller or to slow it excessively.

The invention also consists in a method of producing bags in which a band of flexible material perforated transversely at intervals is formed into a tubular body, a bottom is formed at the end of the tubular body at a folding station including a drum and a folding roller mounted to rotate about parallel axes, the bottom being formed by folding a flap at the end of the tubular body with a folding blade in co-operation with a clamp at the periphery of the drum, and a portion of the tubular body is detached by clamping the tubular body against the drum with a tear-off bar and in a holding station to retain the tubular body by exerting traction on the tubular body when the perforations are between the two stations, the method being characterized in that the portion of tubular body is detached after the formation of the bottom and the rotation of the drum is controlled to synchronize it with the front of the tubular body.

BRIEF DESCRIPTION OF THE FIGURES

The invention will be better understood and other particular features and advantages will become apparent on reading the following description which refers to the appended drawings, in which.

DETAILED DESCRIPTION

Figure 1:
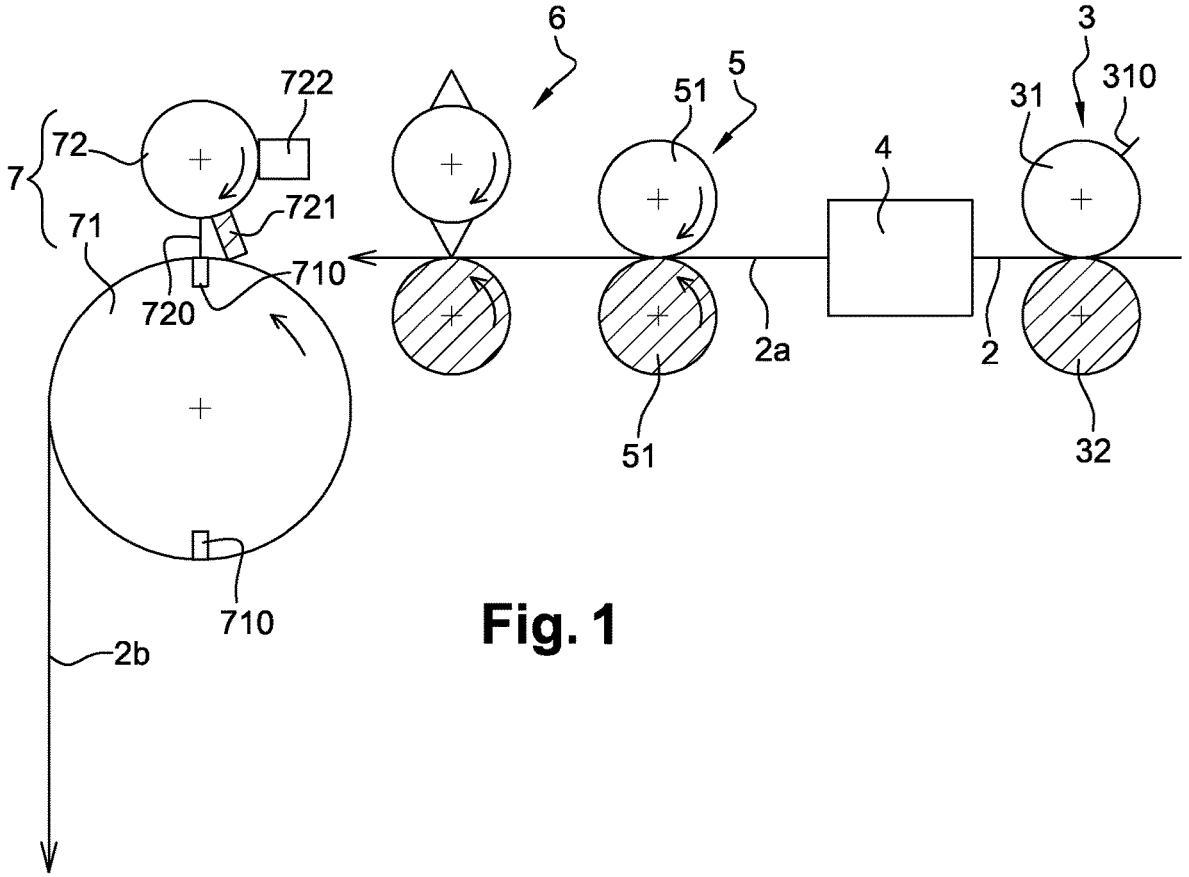
FIG. 1 shows schematically a machine in accordance with first and second embodiments of the invention.

According to one embodiment shown in FIG. 1 a machine for producing bags includes an unwinding station, not shown, for unwinding a band 2 of flexible material and then, in the direction of unwinding of the band 2 indicated by the arrow F1, a perforation station 3 for perforating the band 2 of flexible material transversely at regular or irregular intervals, a station 4 for forming a tubular body 2*a* for forming the band 2 into a tubular body 2*a*, a driving station 5, a holding station 6 for retaining the tubular body 2*a*, and a folding station 7 for forming a bottom 20 at the end of the tubular body 2*a*. The machine further includes transport means, not shown, disposed between the various stations to guide and to transport the tubular body 2*a* between the stations and the bags formed after folding.

The perforation station 3 includes in the conventional manner a blade-holder roller 31 and a counter-roller 32 mounted to rotate about parallel axes. The blade-holder roller 31 includes blades 310 extending along generatrices to perforate the band 2 by clamping it against the counter-roller 32 and forming transverse perforation lines 22*a*, 22*b*.

The station 4 for forming the tubular body 2*a* conforms the perforated band 2 into the tubular body 2*a* in the conventional manner, not described in detail here. It will be noted that the perforations form two offsets transverse lines 22*a*, 22*b* on respective opposite faces of the tubular body 2*a*.

The drive station 5 includes two drive rollers 51 between which the tubular body 2*a* is pinched to be driven at a stable speed that determines the speed of movement of the tubular body 2*a* in the direction of the arrow F1.

The holding station 6 includes two contra rotating holding cylinders 61, 62, the upper holding cylinder 61 including one or two holding bars 610 extending along a generatrix. The holding bars 610 come into contact with the lower holding cylinder 62 once or twice per revolution to clamp the tubular body 2*a* that is moving between the holding cylinders 61, 62. The speed of the holding cylinders 61, 62 is adjusted so the peripheral speed at the level of the holding bars 610 is less than or equal to the speed of movement of the tubular body 2*a*, at least at the time of clamping.

The folding station 7 includes a drum 71 and a folding roller 72 mounted to rotate about parallel axes. The folding roller 72 includes a folding blade 720 to fold a flap 21 at the end of the tubular body 2*a*, a gluing bar 721 for applying glue to the tubular body 2*a* and a tear-off bar 722 for clamping the tubular body 2*a* against the drum 71. The drum 71 includes two clamps 710 distributed on the periphery to grasp the front of the tubular body 2*a*.

The folding station 7 and the holding station 6 are configured jointly to exert traction on the tubular body 2*a* when the perforations are between the two stations 6, 7 and thus to detach a portion of the tubular body 2*a*. The tear-off bar 722 is disposed behind the folding blade 720, i.e. it intervenes to clamp the tubular body 2*a* when the end of the tubular body 2*a* is being folded or has already been folded.

In a first embodiment the drum 71 and the folding roller 72 contra rotate and are synchronized mechanically. The machine further includes control means, not shown, for controlling the rotation of the folding station 7 to synchronize the drum 71 with the front of the tubular body 2*a*. The control means take the form of a synchronous motor for example, also termed a brushless motor, an electronic converter supplying power to the motor and an automatic control unit executing a program for controlling the various parts of the machine, including the converter.

The method employed by the machine will now be described starting from an arbitrary position, knowing that each position also returns on the next cycle. The method comprises a succession of cycles, a bag being produced by each cycle.

Figure 2:
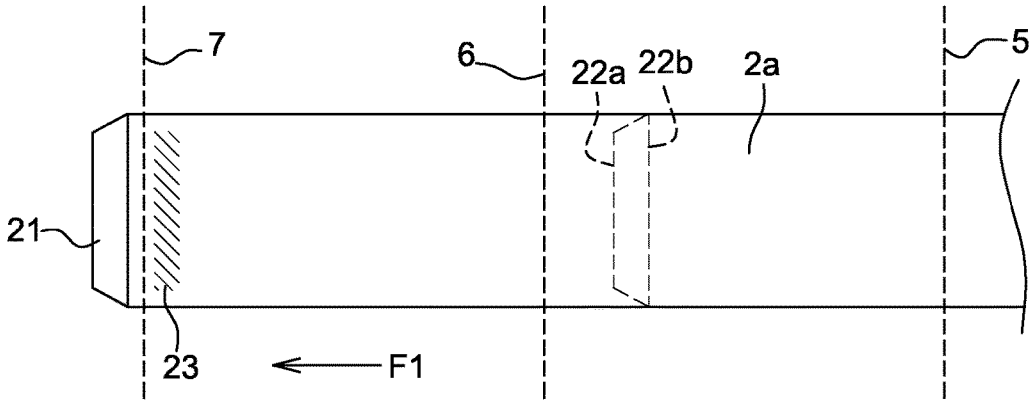
FIGS. 2 to 4 show schematically various steps executed by the machine from FIG. 1.
Figure 3:
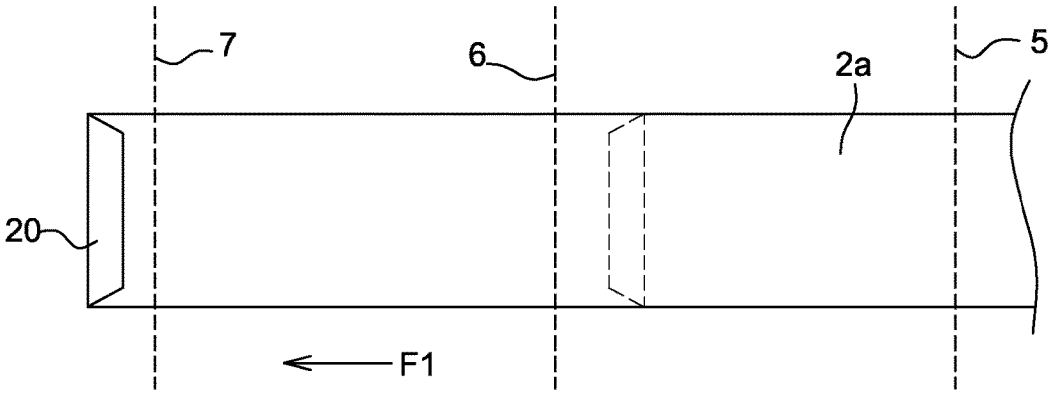
Figure 4:
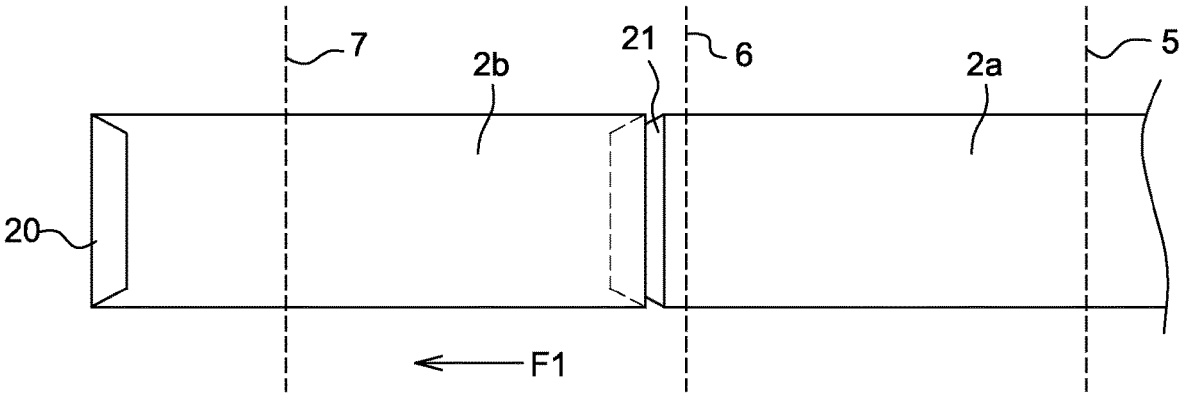

The band 2 of material is unwound by the unwinding station 1, perforated by the perforation station 3 and then formed into the tubular body 2*a* that is pulled by the drive station 5 in the conventional manner, not described in detail here. The tubular body 2*a* passes between the cylinders of the holding station 6 and then between the drum 71 and the folding roller 72. When the front of the tubular body 2*a* arrives between the drum 71 and the folding roller 72 and the peripheral speed thereof is the same as the speed of movement of the tubular body 2*a* the folding blade 720 pushes the tubular body 2*a* into the clamp to imprint a fold, as FIG. 2 shows. The clamp closes onto the fold so a flap 21 projects substantially radially from the drum 71. The gluing bar 721 deposits glue just behind the fold to form a glued area 23 shown in FIG. 2. The movement continuing, the flap 21 is pressed against the glued area 23 by means not shown and thus retained. The bottom 20 of the bag is then formed, as FIG. 3 shows. The tear-off bar 722 then comes into contact with the drum 71 to clamp the tubular body 2*a* when the perforations have passed through the holding station 6 and the retaining bars 610 also come into contact. The tubular body 2*a* is then tensioned to separate it from a length that is already formed into a bag 2*b*, as FIG. 4 shows. The clamp 710 releases the bag before or after the separation of the length, which is then evacuated in the conventional manner. The control means then command an acceleration and then a slowing down of the folding station 7, or vice versa, to move the next clamp 710 into synchronization with the front of the tubular body 2*a* to start a new cycle.

Thus the only adjustment to be effected to change the bag length is intervention at the level of the perforation station 3 to modify the distance between the lines of perforations and the programming of the control means.

The operation of separating the length 2*b* necessitates a speed difference between the drum 71, which must turn faster, and the holding station 6. This difference can be obtained if the drum 71 has released the bag and has begun to accelerate before the separation operation. In the opposite case, in particular when the bag is short and must be separated when the drum has not released the front of the tubular body, the holding station 6 must slow down the tubular body 2*a* for a short time during the separation operation.

In a second embodiment, not specifically shown, the rotation of the drum 71 and the rotation of the folding roller 72 are controlled separately. This is achieved for example by giving the folding roller 72 its own motor, also controlled by the control means. The machine therefore has a greater adjustment possibility. Indeed, the folding roller 72 can be controlled so it intervenes only during the passage of one clamp 710 in two or three. It is thus possible to produce bags longer than the developed drum 71 between two successive clamps 710 with no limit on the length. It is moreover possible to await the appropriate time for the tear-off bar 722 to come into contact with the drum 71 so the perforations are between the holding station 6 and the folding station 7. The speed of the holding station 6 is adjusted so one revolution corresponds to the length of a bag.

According to an improvement, the control means control the perforation station 3 to perforate the band 2 at a chosen location. Accordingly, even the adjustment of the distance between the perforations, determining the length of the bags, can be adjusted in a controlled manner.

According to another improvement, the control means control the holding station 6. Thus even the holding frequency of the tubular body 2*a* and the peripheral speed at the holding station during the tear-off phase can be adjusted in a controlled manner with no necessity for mechanical intervention.

Figure 5:
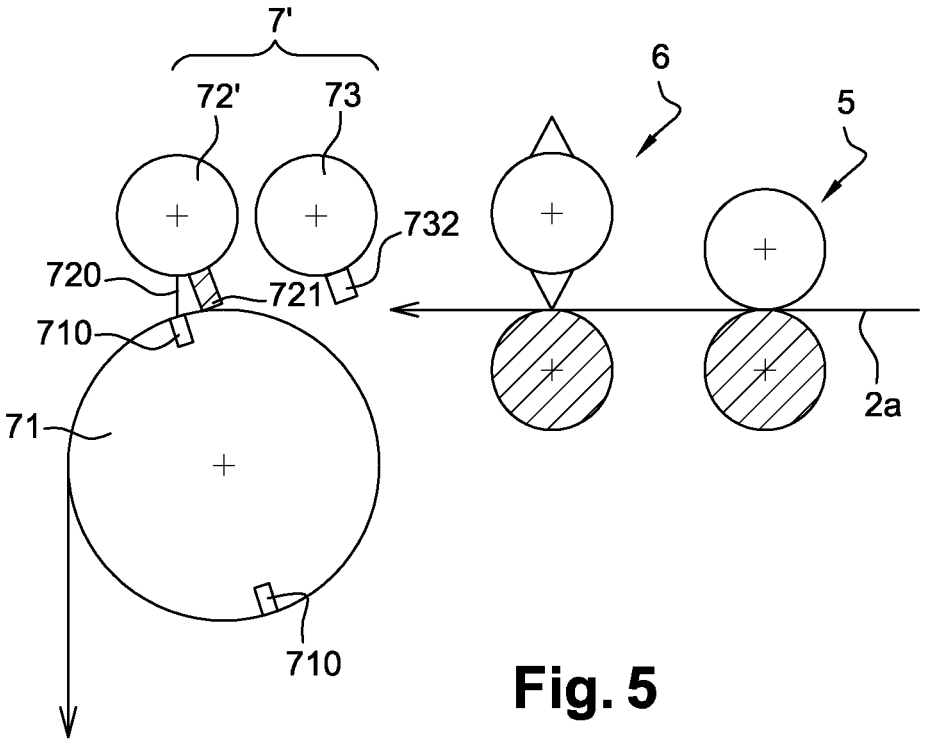
FIG. 5 is a view similar to FIG. 1 of a machine according to a third embodiment of the invention.

In a third embodiment shown in FIG. 5 the folding station 7' differs from that of the first embodiment in that it further includes a tear-off roller 73 carrying the tear-off bar 732. The folding roller 72' therefore no longer includes a tear-off bar. The tear-off roller 73 is mounted to rotate on a shaft offset in the upstream direction relative to the folding roller 72'. The tear-off roller 73 is also controlled by the control means independently of the folding roller 72' to clamp the tubular body 2*a* onto the drum 71 at the appropriate moment and to separate the tubular body by cooperation with the holding station 6.

Figure 6:
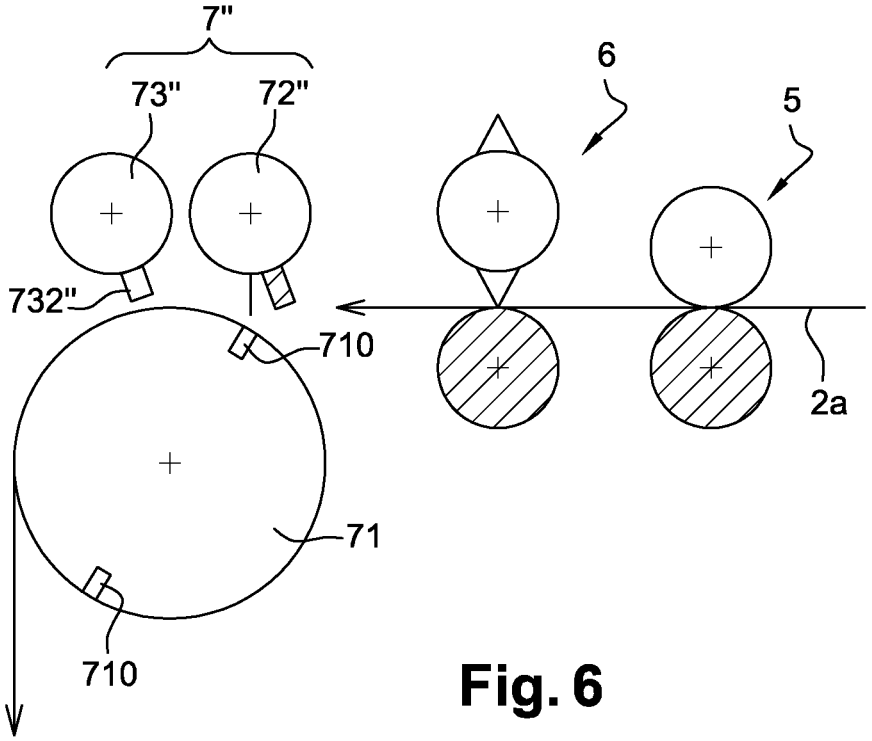
FIG. 6 is a view similar to FIG. 1 of a machine according to a fourth embodiment of the invention.

A fourth embodiment of the invention shown in FIG. 6 differs from the third embodiment in that the tear-off roller 73" is positioned downstream of the folding roller 72" in the same folding station 7". The tear-off roller 73" carrying the tear-off bar 731" is also controlled by the control means independently of the folding roller 72" to clamp the tubular body 2*a* onto the drum 71 at the appropriate moment, after the production of the bottom, and to separate the tubular body by cooperation with the holding station 6. Separation can thus be effected when the separation line is very close to the folding holder 72".

In each embodiment the rollers are controlled to obtain the required speed during the working phases and thus at a very accurate time. This is obtained for example by increasing and then reducing the rotation speed if it is necessary to catch up a delay or to the contrary by reducing and then increasing the rotation speed, or even stopping the roller if necessary. It is even possible to reverse the rotation direction to provide an acceleration travel sufficient to reach the appropriate speed.

The invention is not limited to the embodiments that have just been described by way of example. The drum can include only one clamp, or even three or four. Although the drum 71 is shown as larger than the folding roller, the latter could have an equivalent diameter, or even a smaller diameter, in particular if it carries only one clamp 710. The distance between the perforations need not be regular, to produce successions of bags of different lengths, the machine being capable of adapting to each bag length with no other adjustment.

The invention claimed is:

1. A machine for producing bags, comprising:

a station for forming a tubular body from a band of flexible material that is transversely perforated at intervals;

a holding station for retaining the tubular body;

a folding station for forming a bottom at an end of the tubular body, the folding station comprising:

a drum rotating about a first axis; and a folding roller mounted to rotate about a second axis that is parallel to the first axis, the folding roller comprising a folding blade that folds a flap at the end of the tubular body in co-operation with a clamp at a periphery of the drum to form the bottom;

a tear-off bar that clamps the tubular body against the drum, wherein the folding station and the holding station are configured jointly to exert traction on the tubular body when perforations of the band of flexible material are between the folding station and the holding station and to detach a portion of the tubular body, wherein the tear-off bar is arranged to separate the tubular body when the bottom of the tubular body has already been formed;

the machine further comprising a controller that controls rotation of the drum to synchronize the drum with a front of the tubular body.

2. The machine according to claim 1, wherein the drum and the folding roller are mechanically synchronized.

3. The machine according to claim 1, wherein rotation of the drum and rotation of the folding roller are controlled separately.

4. The machine according to claim 1, wherein the tear-off bar is carried by the folding roller.

5. The machine according to claim 1, wherein the tear-off bar comprises a tear-off roller carrying the tear-off bar.

6. The machine according to claim 1, further comprising a perforation station to perforate transversally the band of flexible material.

7. The machine according to claim 6, wherein the perforation station is controlled to perforate the band of flexible material at a chosen location.

8. The machine according to claim 1, wherein the controller controls the holding station.

9. The machine according to claim 1, wherein the drum comprises two clamps arranged on a periphery to grasp the front of the tubular body.

10. The machine according to claim 1, wherein the folding blade is cyclically retractable.

11. A method of producing bags comprising:

transversely perforating a band of flexible material at intervals;

forming, at a folding station, a bottom at an end of the tubular body, the folding station comprising:

a drum mounted to rotate about a first axis; and a folding roller mounted to rotate about a second axis that is parallel to the first axis;

the bottom being formed by folding a flap at the end of the tubular body by a folding blade carried by the folding roller in co-operation with a clamp at a periphery of the drum;

detaching a portion of the tubular body by clamping the tubular body against the drum with a tear-off bar;

retaining, in a holding station, the tubular body by exerting traction on the tubular body when perforations of the band of flexible material are between the folding station and the holding station; wherein the portion of tubular body is detached after the formation of the bottom and rotation of the drum is controlled to synchronize the drum with a front of the tubular body.

* * * * *